US009267747B2

(12) United States Patent
Caudle

(10) Patent No.: US 9,267,747 B2
(45) Date of Patent: Feb. 23, 2016

(54) RECOIL MECHANISM, SYSTEM, AND METHOD

(71) Applicant: Carl Eugene Caudle, Moses Lake, WA (US)

(72) Inventor: Carl Eugene Caudle, Moses Lake, WA (US)

( * ) Notice: Subject to any disclaimer, the term of this patent is extended or adjusted under 35 U.S.C. 154(b) by 0 days.

(21) Appl. No.: 14/020,414

(22) Filed: Sep. 6, 2013

(65) Prior Publication Data

US 2014/0059909 A1 Mar. 6, 2014

Related U.S. Application Data

(60) Provisional application No. 61/697,508, filed on Sep. 6, 2012.

(51) Int. Cl.
*F41A 3/84* (2006.01)
*F41A 3/68* (2006.01)

(52) U.S. Cl.
CPC .... *F41A 3/84* (2013.01); *F41A 3/68* (2013.01)

(58) Field of Classification Search
USPC ..... 42/1.06, 71.01; 89/198, 199; 124/89
See application file for complete search history.

(56) References Cited

U.S. PATENT DOCUMENTS

| | | | | | |
|---|---|---|---|---|---|
| 2,504,958 | A * | 4/1950 | Botts et al. | 89/198 |
| 2,731,753 | A * | 1/1956 | Mathieu | 42/74 |
| 3,683,534 | A * | 8/1972 | Davis | 42/1.06 |
| 4,663,877 | A * | 5/1987 | Bragg | 42/74 |
| 4,667,566 | A * | 5/1987 | Bosshard et al. | 89/44.01 |
| 4,986,018 | A * | 1/1991 | McDonald, Jr. | 42/1.06 |
| 5,044,351 | A * | 9/1991 | Pfeifer | 124/89 |
| 5,460,156 | A * | 10/1995 | Sappington | 124/89 |
| 6,481,143 | B2 * | 11/2002 | McCarthy | 42/74 |
| 6,758,126 | B1 * | 7/2004 | Houtsma | 89/198 |
| 7,478,495 | B1 * | 1/2009 | Alzamora et al. | 42/74 |
| 7,493,845 | B2 * | 2/2009 | Mantas | 89/42.01 |
| 2006/0048637 | A1 * | 3/2006 | Dimitrios | 89/14.3 |

FOREIGN PATENT DOCUMENTS

DE 3739448 A1 * 3/1989 ..... F41D 11/12

* cited by examiner

*Primary Examiner* — Jonathan C. Weber
(74) *Attorney, Agent, or Firm* — Timberline Patent Law Group PLLC

(57) ABSTRACT

Systems, mechanisms and methods are disclosed herein for absorbing recoil within a firearm. A first recoil absorption mechanism and second recoil absorption mechanism may be moved relative to each other in response to one or more recoil forces. At a certain point, the second recoil absorption mechanism moves toward and collides with the first recoil absorption mechanism. These forces, which are in part translated to the springs, reduce the amount of recoil experienced by the user of the firearm.

2 Claims, 3 Drawing Sheets

RECOIL MECHANISM, SYSTEM, AND METHOD

BACKGROUND

Conventional firearms and guns experience a backward momentum or recoil when the gun or firearm is discharged. In small arms, the recoil force is absorbed by the person firing the firearm. For larger armaments, the momentum may be shifted through a mount to the ground. For rifles, shotguns, machine guns, and other butted guns, the force may be somewhat absorbed through a simple spring, which is typically located behind the bolt and within the stock of the gun.

Some or all of the problems explained above and other problems may be helped or solved by one or more embodiments of the inventions shown and described herein. Such inventions may also be used to address other problems not set out above or which are only understood or appreciated at a later time. The future may also bring to light currently unknown or unrecognized benefits which may be appreciated or more fully appreciated in association with the inventions shown and described herein.

It should be recognized that the needs and expected benefits explained hereinabove are not admissions that others may have recognized such problems prior to the inventions described herein and thus are not admitted as prior art.

BRIEF DESCRIPTION OF THE DRAWINGS

Preferred forms, configurations, embodiments and/or diagrams relating to and helping to describe preferred aspects and versions of the inventions are explained and characterized herein, often with reference to the accompanying drawings. The drawings and all features shown therein also serve as part of the disclosure of the inventions of the current document, whether described in text or merely by graphical disclosure alone. Such drawings are briefly described below.

DETAILED DESCRIPTION

Figure 1:
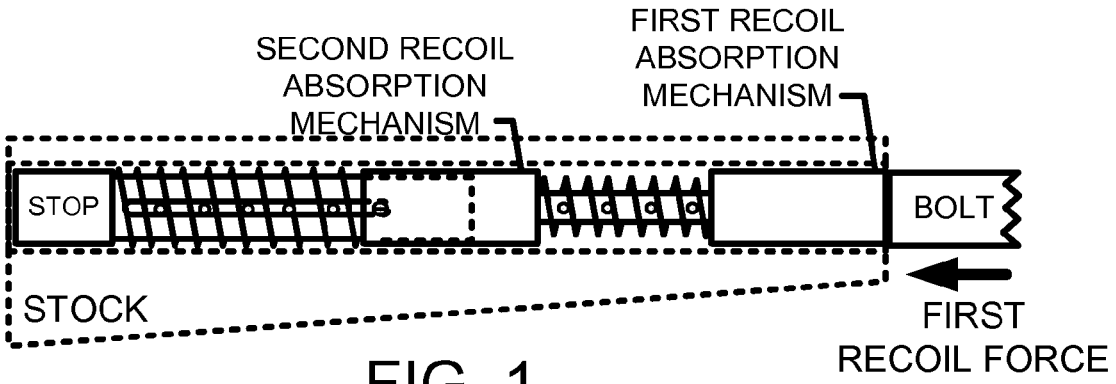
FIGS. 1-5 are side cross-sectional views of one implementation of a recoil absorption mechanism and system.
Figure 2:
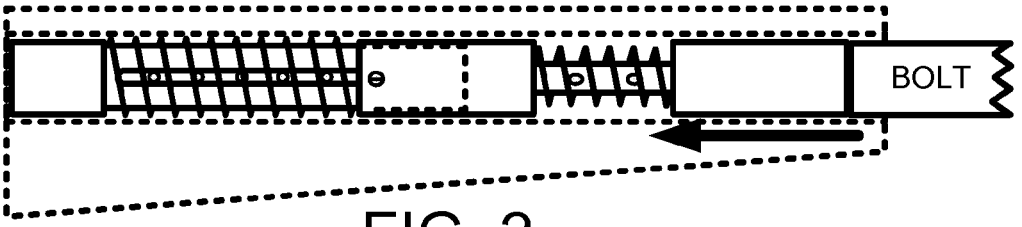

According to one implementation, a recoil absorption mechanism may be placed in a cavity of a stock, or so-called butt end, of a firearm. The entire firearm is not shown for the sake of simplicity, but one skilled in the art will appreciate that only the portions necessary to understand this disclosure are provided within the context of a conventional firearm.

The recoil absorption mechanism may be comprised of a first absorption mechanism, which may be directly or indirectly coupled to and/or in pressed contact with the bolt of the firearm. The first absorption mechanism may be termed a bolt follower as it may travel with the bolt as the bolt cycles through each discharge of the firearm. The first absorption mechanism may travel along a bolt follower shaft. This shaft may be provided with holes as shown in FIGS. 1-5 to allow gas and/or fluid to pass through the shaft and thereby prevent build up of pressure in the stock as the bolt and bolt follower move within the cavity of the stock. The holes may also permit general irrigation of fluids, gasses, and other debris. The first absorption mechanism may be held against the bolt using the spring force of a spring placed between a bump stop and the first absorption mechanism. The spring may be generally compressed when within the cavity of the stock. This configuration maintains a linear force against the bolt as the fire arm is discharged and the bolt is cycled through a round of ammunition. The first recoil absorption mechanism may further have a notched end that is configured to engage with a collar of the bolt. This configuration maintains alignment between the bolt and the recoil absorption mechanism, which improves the bolt cycling process and reduces friction and other the forces associated with the bolt cycling action. The first recoil absorption mechanism may also be provided with a low friction surface, such as a plastic material, which may reduce friction in the cavity and thereby further improve the cycling action of the bolt and bolt follower. In one implementation, shown in FIGS. 7 and 8, the bolt follower is provided with a low friction bolt follower bearing around or encasing the bolt follower. In that instance, the bolt follower may be comprised of a material such as steel, while the bolt follower bearing may be a low friction material, such as plastic or other suitable material.

The bump stop may be generally cylindrically shaped and may be provided with one closed end that is placed on the rearward end of the cavity in the stock, but may otherwise be a hollow cylinder. As shown in FIGS. 1-5, the bolt follower shaft may be engaged with the closed end of bump stop using a cotter pin, clip, or other mechanism (not shown) or may simply be held in place between two portions of the firearm housing. The bolt follower spring may be held between the bump stop and the bolt follower. The bump stop may be provided with a slit or slot to allow gas, fluid or solid debris from building up within the cavity. The slot may also be configured to allow a second recoil absorption mechanism to slidably engage the bump stop as will be described in further detail below.

The second absorption mechanism may be collar or hollow cylinder shaped mechanism that may slide along the bump stop to act as an inertial dampener. Its movement may be limited by a pin, bolt, screw or other similar mechanism that engages with the slot of the bump stop. A spring may be provided between the second recoil absorption mechanism and a spring stop of the bump stop. The spring stop may be integral with the bump stop and may simply be a wider portion that holds one end of the spring in place. The spring may be in compression between the spring stop and the second recoil absorption mechanism, which is in turn held in place by a pin inserted through the second recoil absorption mechanism and one of end of the slot, as shown by the dotted line in FIGS. 1 and 2. The second recoil absorption mechanism may be constructed of metal, plastic, or other suitable material, including a material that reduces friction within the cavity of the stock or along the bump stop. The bump stop may be made of any combination of metal, plastic, or other suitable material. The second recoil absorption mechanism may be suitably sized or weighted to provide the desired recoil absorption characteristics.

According to an implementation, the first and second springs are held in compression between the first absorption mechanism, the second absorption mechanism and the stop.

The technique of recoil absorption may be more clearly understood with further reference to FIGS. 1-6. As shown in FIG. 1, a first recoil force is created as the gun is discharged and a propellant is ignited in the ammunition. The force causes at least the first recoil absorption mechanism to move toward the rearward end of the cavity in the stock, compressing (or further compressing) the first recoil spring (or bolt follower spring).

Figure 3:
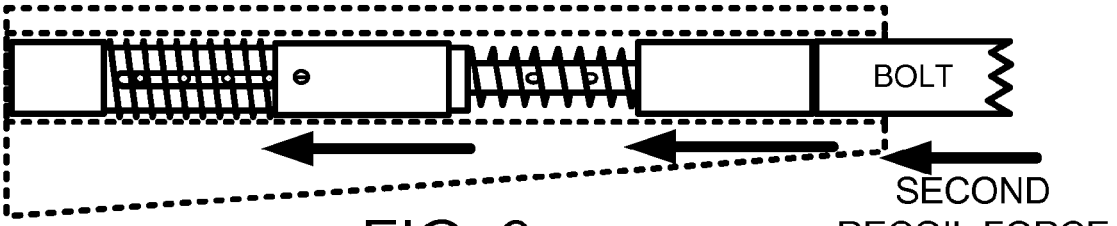
Figure 4:
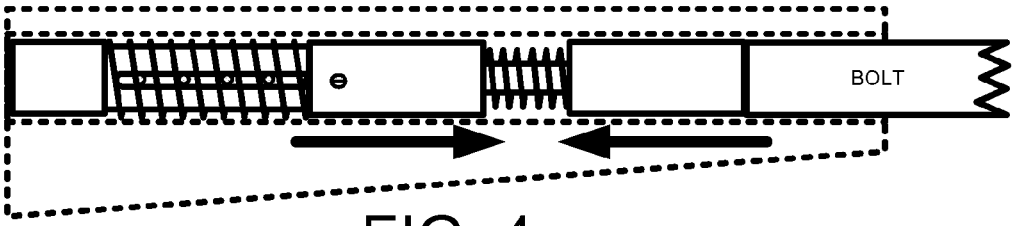
Figure 5:
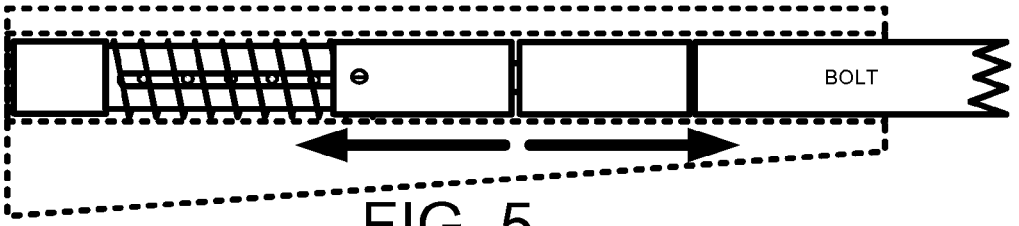
Figure 6:
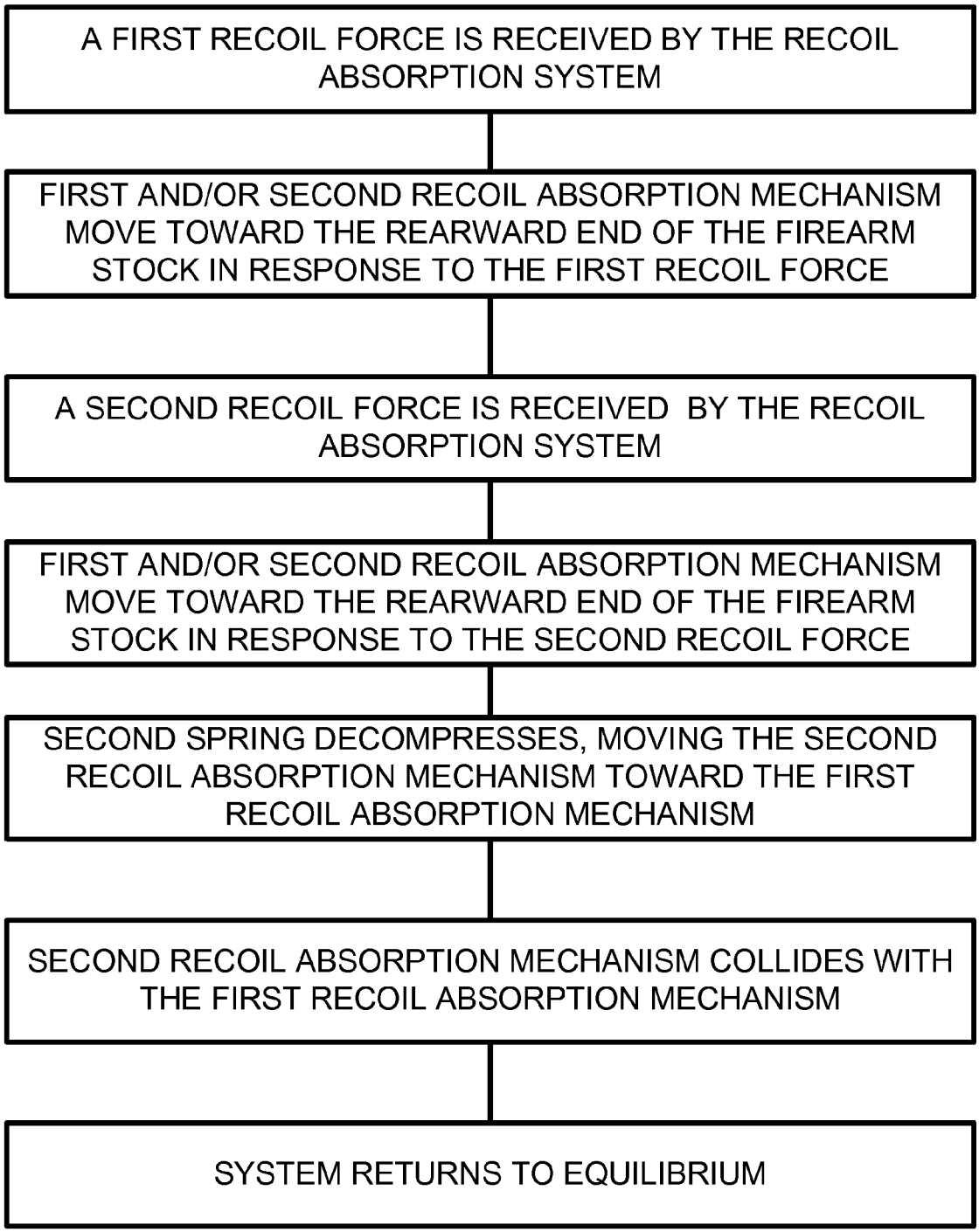
FIG. 6 is a flow diagram of one implementation of a method of absorbing recoil.

The first recoil force or a second recoil force, such as may be caused as the bullet leaves the barrel of the firearm, may cause the second recoil absorption mechanism to move toward the rearward end of the cavity in the stock, as shown in FIG. 3. This action compresses the spring between the second recoil absorption mechanism and the spring stop associated with the bump stop. At a certain point, the force within the spring between the second recoil absorption mechanism and the spring stop exceeds the rearward force of the second recoil absorption mechanism causing the spring to decompress, thus reversing the direction of travel of the second recoil absorption mechanism as shown in FIG. 4.

As the second recoil absorption mechanism moves forward, the first recoil mechanism is still travelling toward the rearward end of the cavity in the stock. This may cause the first and second recoil absorption mechanisms to collide. The compression of the first spring and/or the collision of the first and second recoil absorption mechanisms reduce the recoil force experienced by the person holding the firearm. The springs and first and second recoil absorption mechanisms proceed toward equilibrium and eventually return to their original position, shown in FIG. 5.

The first and second springs may be replaceable such that different springs may be utilized for different circumstances. Thus, the recoil absorption system may be optimized for a given barrel length, ammunition used, recoil absorption characteristics and so forth. Moreover, the length, size, weight, and other characteristics of the first recoil absorption mechanism, the second recoil absorption mechanism, and/or the bump stop may be adjusted to optimize the recoil absorption characteristics for each firing scenario. The first recoil absorption mechanism, the second recoil absorption mechanism, and/or the bump stop may be provided with a dampening material, such as plastic, rubber, or other suitable material to further reduce the concussive force of the recoil.

Figure 7:
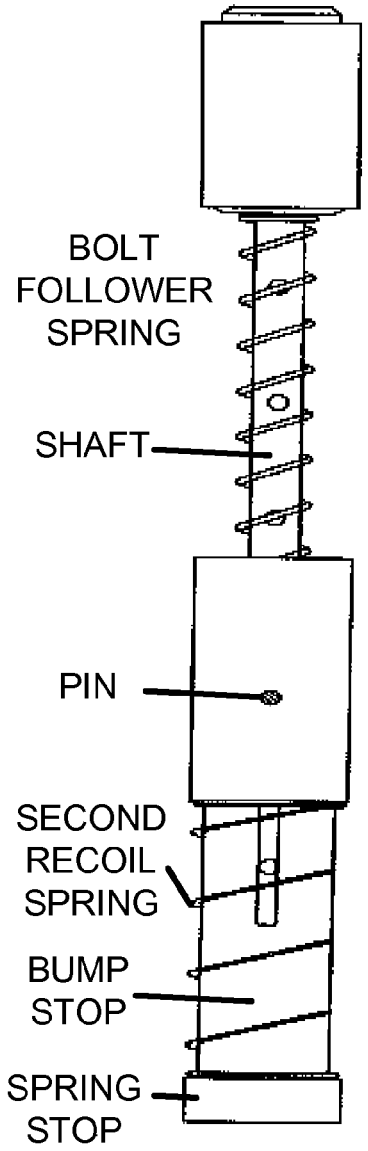
FIG. 7 is a side profile view of the recoil absorption system.
Figure 8:
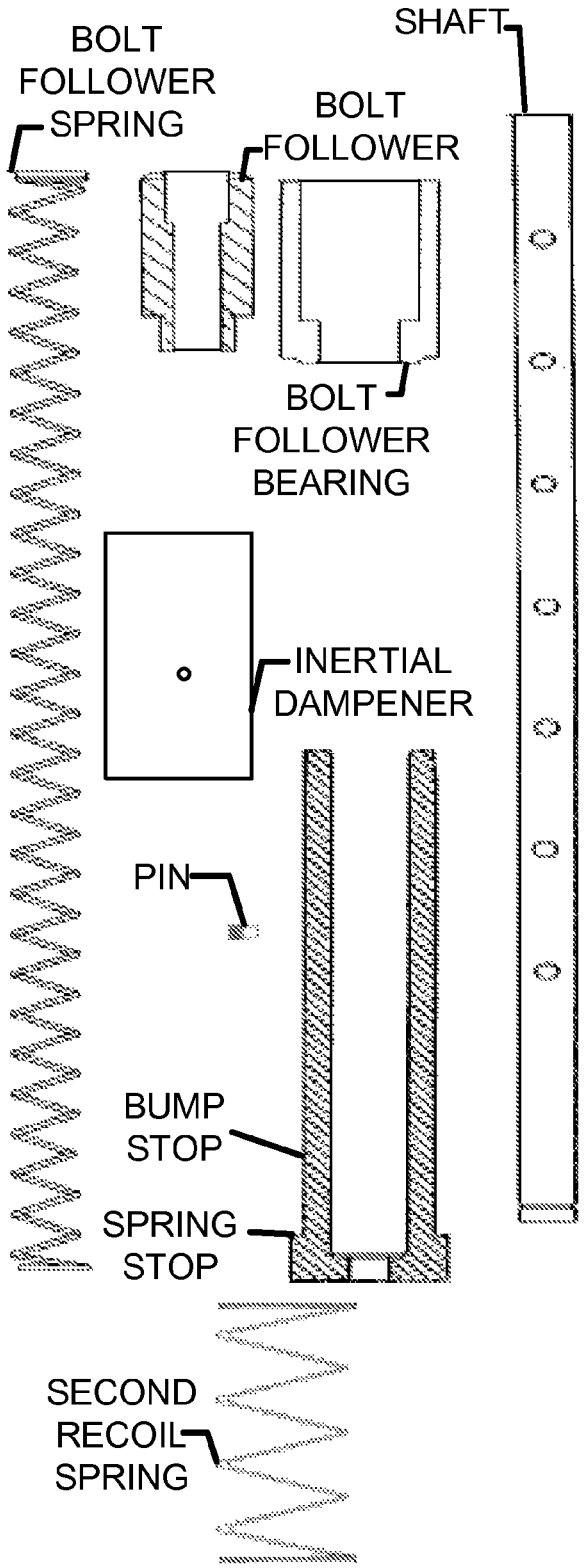
FIG. 8 side profile and cross-sectional views of components of the recoil absorption system shown in FIG. 7.

FIGS. 7 and 8 show the various components of a recoil reduction mechanism according to one implementation in which the bolt follower is provided with a bolt follower bearing. FIG. 8 in particular shows the components of the system as disassembles, with certain components shown in cross section for clarity.

The above description has set out various features, functions, methods and other aspects of the inventions. This has been done with regard to the currently preferred embodiments thereof. Time and further development may change the manner in which the various aspects are implemented. Such aspects may further be added to by the language of the claims which are incorporated by reference hereinto as originally filed.

The scope of protection accorded the inventions as defined by the claims is not intended to be necessarily limited to the specific sizes, shapes, features or other aspects of the currently preferred embodiments shown and described. The claimed inventions may be implemented or embodied in other forms while still being within the concepts shown, described and claimed herein. Also included are equivalents of the inventions which can be made without departing from the scope of concepts properly protected hereby.

I claim:

1. A recoil absorption mechanism for a bolt of a gun comprising:

a shaft coaxial with the bolt of the gun;

a first recoil absorption mechanism, comprising:

a bolt follower slidably coupled to the shaft;

an inertial dampener slidably coupled to the shaft;

a first recoil spring disposed around the shaft to transfer a recoil force from the bolt follower to the inertial dampener;

a second recoil absorption mechanism slidably coupled to the shaft, comprising:

a second recoil spring disposed around the shaft between the inertial dampener and a stop;

the second recoil spring configured to reverse a direction of travel of the inertial dampener to collide the inertial dampener into the bolt follower to reduce the recoil force.

2. The recoil absorption mechanism of claim 1, wherein the first recoil spring returns the bolt follower and the inertial dampener to an equilibrium state after the recoil force is reduced.

* * * * *